US005716264A

United States Patent [19]

Kimura et al.

[11] Patent Number: 5,716,264

[45] Date of Patent: Feb. 10, 1998

[54] POLISHING APPARATUS

[75] Inventors: Norio Kimura, Kanagawa-ken; Ritsuo Kikuta, Chiba-ken; You Ishii; Masayoshi Hirose, both of Kanagawa-ken, all of Japan

[73] Assignee: Ebara Corporation, Tokyo, Japan

[21] Appl. No.: 683,424

[22] Filed: Jul. 18, 1996

[30] Foreign Application Priority Data

Jul. 18, 1995 [JP] Japan ..... 7-203906

[51] Int. Cl.[6] ..... B24B 21/18

[52] U.S. Cl. ..... 451/443; 451/41; 451/60; 451/285; 451/286; 451/287; 451/288; 451/289; 451/290

[58] Field of Search ..... 451/285–290, 451/443, 41, 60; 134/153, 144

[56] References Cited

U.S. PATENT DOCUMENTS

| | | | |
|---|---|---|---|
| 4,680,893 | 7/1987 | Cronkhite et al. . | |
| 5,154,021 | 10/1992 | Bombardier et al. . | |
| 5,384,986 | 1/1995 | Hirose et al. | 451/444 |
| 5,531,635 | 7/1996 | Mogi et al. | 451/443 |
| 5,558,110 | 9/1996 | Williford | 134/153 |
| 5,578,529 | 11/1996 | Mullins | 451/41 |

FOREIGN PATENT DOCUMENTS

| | | | |
|---|---|---|---|
| 402116471 | 5/1990 | Japan | 451/287 |
| 10769 | 1/1991 | Japan | 125/11.01 |
| 3-148825 | 6/1991 | Japan . | |
| 3-228569 | 10/1991 | Japan . | |

*Primary Examiner*—Robert A. Rose
*Assistant Examiner*—George Nguyen
*Attorney, Agent, or Firm*—Wenderoth, Lind & Ponack

[57] ABSTRACT

A polishing apparatus is employed to polish an object to be polished by urging the surface of the object to be polished against the surface of a polishing cloth and causing a relative movement therebetween, while supplying a polishing liquid into an area between the object to be polished and the polishing cloth. A plurality of nozzles spray respective fluid jets to strike against the surface of the cloth. The plurality of nozzles include more than one type of nozzle which vary flow velocity, flow rate, angle of spray, and cross-sectional configuration of a jet. The plurality of nozzles have axes positioned at a location at different distances from the rotation axis of the polishing cloth.

59 Claims, 6 Drawing Sheets

POLISHING APPARATUS

BACKGROUND OF THE INVENTION 1. (Field of the Invention)

The present invention relates to a polishing apparatus for polishing an object such as a semiconductor wafer and the like that is required to be polished into a flat mirror-like configuration an including a polishing cloth provided on a turntable, and more particularly to such a polishing apparatus which provides an optimum dressing operation of the polishing cloth.

2. (Prior Art)

With the increasing use of highly integrated circuits such as LSI and VSLI, etc., inter-linear distances in circuits have become increasingly short. Industry thus is using light sources having a shallower focal depth in comparison to the prior art in a lithograph operation for forming a circuit. The use of a shallow focal depth light source has brought about a demand for wafers having surfaces with increased flatness. Additionally, with the evolution of multi-layered configurations, wafers have to have a substantially even surface after individual layers are formed. A polishing apparatus is one means for processing a semiconductor wafer to have a flat surface.

The polishing apparatus comprises a turntable which has a polishing cloth provided on its surface, a top ring for pressing the wafer surface to be polished toward the polishing cloth, and means for feeding an abrasive liquid in which abrasive grains are contained. In this polishing apparatus, the step of flattening the wafer surface, i.e. the polishing step, is carried out by rotating the turntable and the top ring, whereby the wafer retained in position by the top ring is urged against the polishing cloth while abrasive liquid is fed onto the surface of the polishing cloth.

During the polishing operation, abrasive liquid is supplied onto the polishing cloth surface, and the liquid is retained within and upon the surface of the polishing cloth for a certain time interval. The wafer surface is polished by means of the abrasive liquids with the abrasive liquid being replaced with fresh liquid at intervals and discharged out of the turntable.

However, the following problems arise:

① Abrasive grains in the liquid are progressively reduced in size, and consequently grains with decreased polishing ability may accumulate within the polishing cloth, instead of being discharged.

② Distribution of abrasive grains in the polishing cloth may not be even.

③ Fibers in the polishing cloth gradually collapse, whereby the cloth loses the capability of retaining abrasive grains.

④ Resiliency of the polishing cloth decreases.

Consequently, the polishing cloth must be renewed at regular intervals by a dressing operation. Conventionally, dressing of a polishing cloth has been carried out by scrubbing the surface of the polishing cloth with a brush, or by spraying a fluid jet against the surface of the polishing cloth.

(Problems to be Solved by the Invention)

However, the polishing cloth may not be sufficiently renewed by such procedures using brushes, such that the polishing rate varies after dressing. Dressing is also carried out by scrubbing the polishing cloth with a plate to which diamond grains are applied. In this case, the polishing cloth has a reduced working life.

Because a fluid jet which is sprayed against the object is a uniform jet, there also arises a problem that the polishing surface may not be sufficiently flat due to an uneven distribution of abrasive grains even after dressing.

The present invention has been made with the above described situation as a background, and the object of the invention is to provide a polishing apparatus which polishes a wafer with the entire surface of a polishing cloth in an even manner.

SUMMARY OF THE INVENTION (Means for Solving the Problem)

In order to solve the above-described problems, the present invention is characterized in that there is provided a polishing apparatus adapted to polish an object to be polished by urging a surface of the object to be polished against a surface of the polishing cloth and causing a relative movement therebetween, while supplying a polishing liquid into an area between the object to be polished and the polishing cloth. The apparatus includes a dressing system including a plurality of nozzles each being adapted to spray a fluid jet to strike against the surface of the polishing cloth. The plurality of nozzles includes more than one type of nozzle to thereby vary at least one of a flow velocity, flow rate, angle of spray, and cross-sectional configuration of the fluid jet. Axes of the plurality of nozzles are positioned at different distances from a rotational axis of the polishing cloth.

Further, even if the number of nozzles is one or a few, the present invention can also provide an effect similar to one obtained when the above-described plurality of nozzles is used, by allowing the nozzle or nozzles to be movable over the polishing cloth during a dressing operation. Furthermore, the present invention provides a more efficient dressing operation by allowing cavitation bubbles to be blended into a fluid jet, thereby increasing an impact pressure by the collapse of cavitation bubbles.

(Operation)

The operation of the present invention will be described hereinbelow.

By allowing the fluid jet to have a varied flow velocity, flow rate, angle of spray, and cross-sectional configuration in accordance with the present invention, it becomes possible to control a water impact pressure when the jet strikes against the surface of the polishing cloth, as well as a location and an area to be effected by the water impact pressure.

The collision pressure which may be created by the fluid jet when it strikes against the surface of the polishing cloth may be a water impact pressure, and it can be represented by the following equation $$P=\rho CV$$

where P is the water impact pressure, ρ is the density of fluid, C is the sonic velocity and V is the flow velocity of the fluid as it collides (immediately before collision). This corresponds to the water impact pressure to be provided by the fluid in a unit area. The volume may be greater or smaller, depending on whether the flow rate is more or less. The flow volume may be great when the total amount of water impact pressure is great.

The volume of fluid per unit surface area and unit time of the total water impact pressure next will be described in the context of impact pressure. Variation in the angle of spray of the fluid jet and its cross-sectional configuration means that the jet may be sprayed against a different portion of the cloth surface where its configuration and surface area vary. Generally, if the jet is supplied from the same fluid source, the effect may occur that the greater the angle of the spray, i.e., the more the cross-sectional configuration of the spray diverges, the smaller the impact pressure per unit surface area is. Conversely, the narrower the cross-sectional configuration is, the greater the impact pressure per unit area will be.

Further, the fluid source which is provided for respective nozzles can be used to adjust the jet, rather than varying the distribution of the jet through use of different nozzles. This alternative approach may result in an increase in energy in the fluid source, causing a greater impact pressure on the surface of the cloth. An orifice or a valve provided between the fluid source and the respective nozzle may adjust the jet, restricting the orifice or the valve resulting in a lower impact pressure.

From the above-description, it will be understood that the possible distribution of an impact pressure over the surface of a polishing cloth may be controlled by selecting a nozzle type, etc., in accordance with the present invention.

On the other hand, there still remain several problems which must be overcome by the dressing operation, including abrasive grains being left in an uneven pattern, and fibers collapsing in an uneven manner. Consumed abrasive grains occur in greater volume at the center of an area to be used in a polishing operation, or at an area adjacent to a central trajectory of the center of the top ring on the cloth surface. Thus, from the viewpoint of removal of abrasive grains which remain, increasing the impact pressure of the fluid jet causes more abrasive grains to be discharged. As for the recovery of cloth which has been compressed, results vary depending on the structure and type of the cloth.

Accordingly, selection of a nozzle is generally made such that the fluid jet may strike with a greater impact pressure an area adjacent to a central area which is used in a polishing operation and in which used abrasive grains tend to collect. It is also possible to control impact pressure depending on the polishing conditions, etc. Even if a single or a reduced number of nozzles is used, control may be effected in a similar manner as that when a plurality of nozzles is employed, by allowing the nozzle or nozzles to move above the polishing cloth during the dressing operation. Moreover, by varying the rotating velocity of the turntable upon which the polishing cloth is applied during the dressing operation, finer control may be achieved. Furthermore, if cavitation bubbles are blended into the fluid jet, an increased impact pressure may be obtained from collapse of the bubbles, and consequently a more effective dressing operation may be achieved.

Further, in accordance with the present invention, splashing of liquid is prevented which would otherwise occur when the fluid jet is used to dress the polishing cloth. Moreover, use of the fluid jet is facilitated by using water as a fluid jet stream.

DESCRIPTION OF THE PREFERRED EMBODIMENTS

Figure 1:
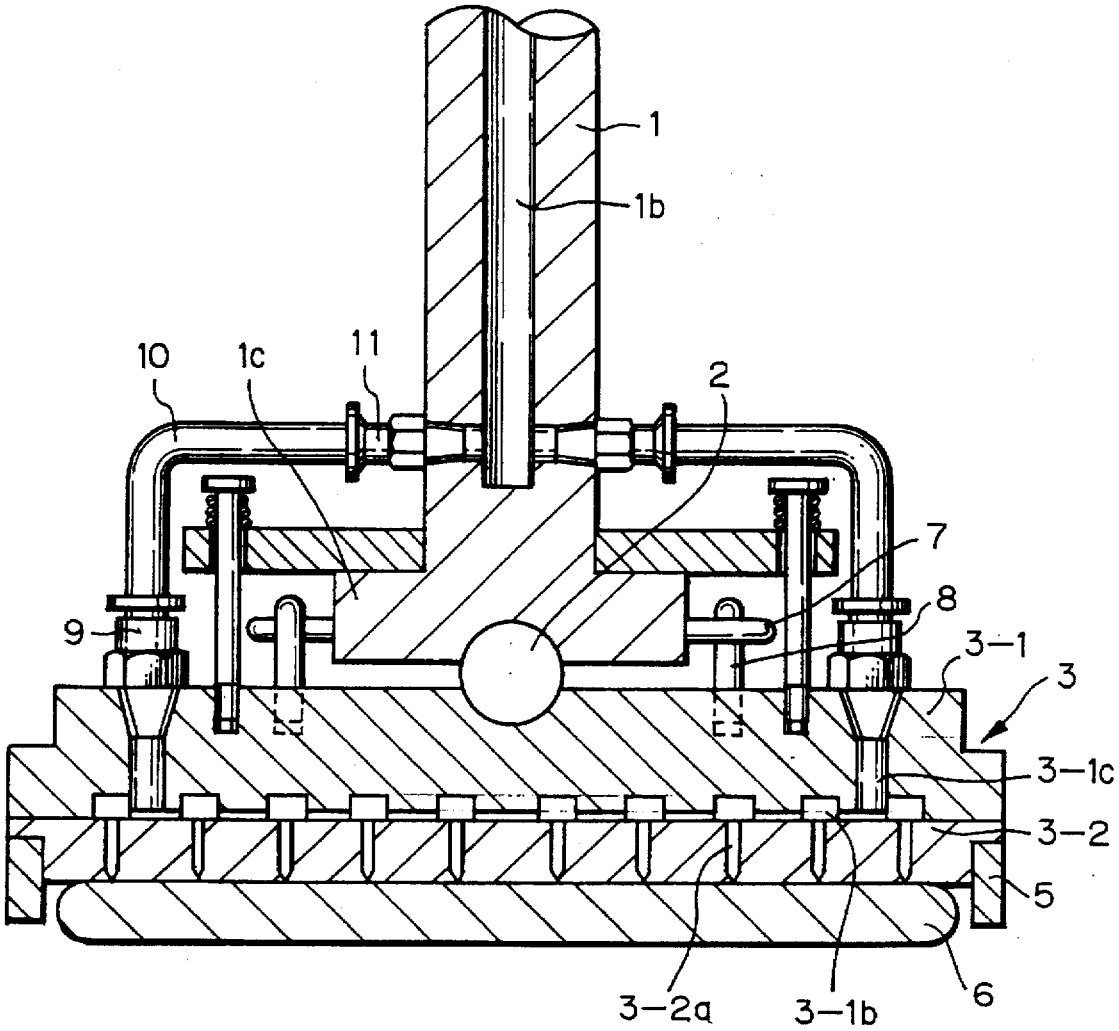
FIG. 1 is a longitudinal cross-sectional view showing a polishing portion in the polishing apparatus in one embodiment of the present embodiment.
Figure 2:
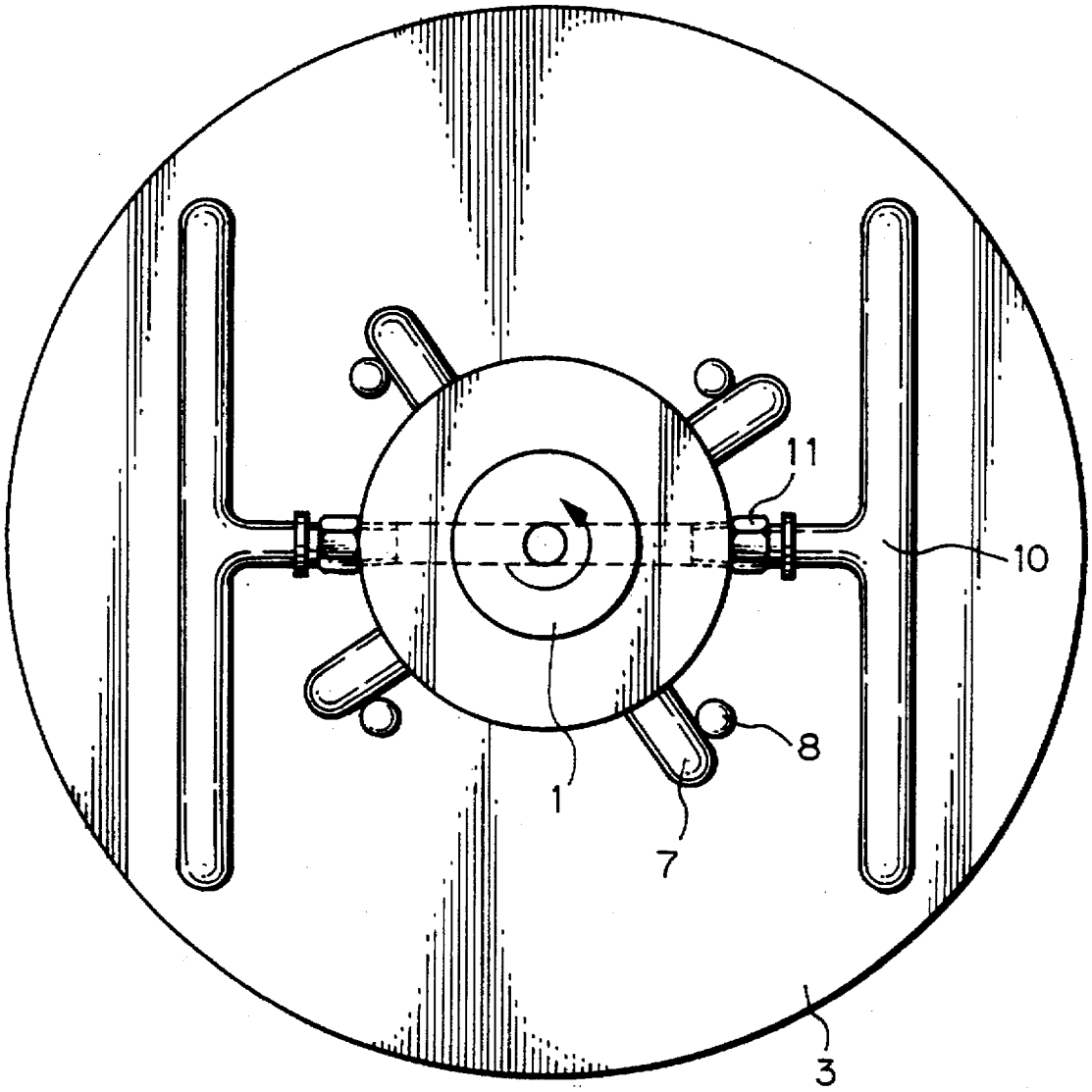
FIG. 2 is a plan view of the polishing portion in the polishing apparatus in one embodiment of the present embodiment.

One embodiment of the polishing apparatus in accordance with the present invention will be described hereinbelow. FIGS. 1 and 2 are views showing the polishing section of the polishing apparatus for use with semiconductor wafers, in which FIG. 1 is a longitudinal cross-section and FIG. 2 is a plan view. The top ring portion of the polishing apparatus comprises a top ring driving shaft 1, a top ring 3, and a ball bearing 2 which is interposed between the top ring driving shaft I and the top ring 3.

The top ring 3 is formed by the top ring body upper portion 3-1 and the top ring body lower portion 3-2, and ring 5 for preventing removal of the wafer is arranged around the outer periphery of the top ring body lower portion 3-2.

The top ring body lower portion 3-2 is formed at its lower surface with a number of vacuum suction ports 3-2*a*. The top ring body upper portion 3-1 is formed with vacuum grooves 3-1*b* which are in communication with these vacuum section ports 3-2*a*, and these vacuum grooves 3-1*b* are also in communication with four vacuum suction ports 3-1*c* which are defined in the top ring body upper portion 3-1. These vacuum ports 3-1*c* are in communication with a vacuum port 1*b* defined through the central portion of the top ring driving shaft 1 by means of vacuum line tubes 10 and tube joints 11.

The top ring driving shaft 1 is integrally provided with the flange portion 1*c*, and four torque transmitting pins 7 are arranged around the outer periphery of the flange portion 1*c*. The top ring body upper of the top ring 3 is provided at its upper surface with four torque transmitting pins 8 each of which corresponds to a torque transmission pin 7. A semiconductor wafer 6 is contained in a space enclosed by the lower surface of the top ring body lower portion 3-2, the inner periphery of the wafer removal-preventive ring 5 and the upper surface of the turntable (to be described later), and the turntable is caused to rotate simultaneously with the rotation of the top ring driving shaft 1. The resulting rotation torque is transmitted to the top ring 3 through engagement between the torque transmitting pins 7 and 8, and it may turn the top ring 3. At the same time, the surface of the semiconductor 6 is polished to have a flat and mirror-like surface, while allowing the top ring to slide.

Figure 3:
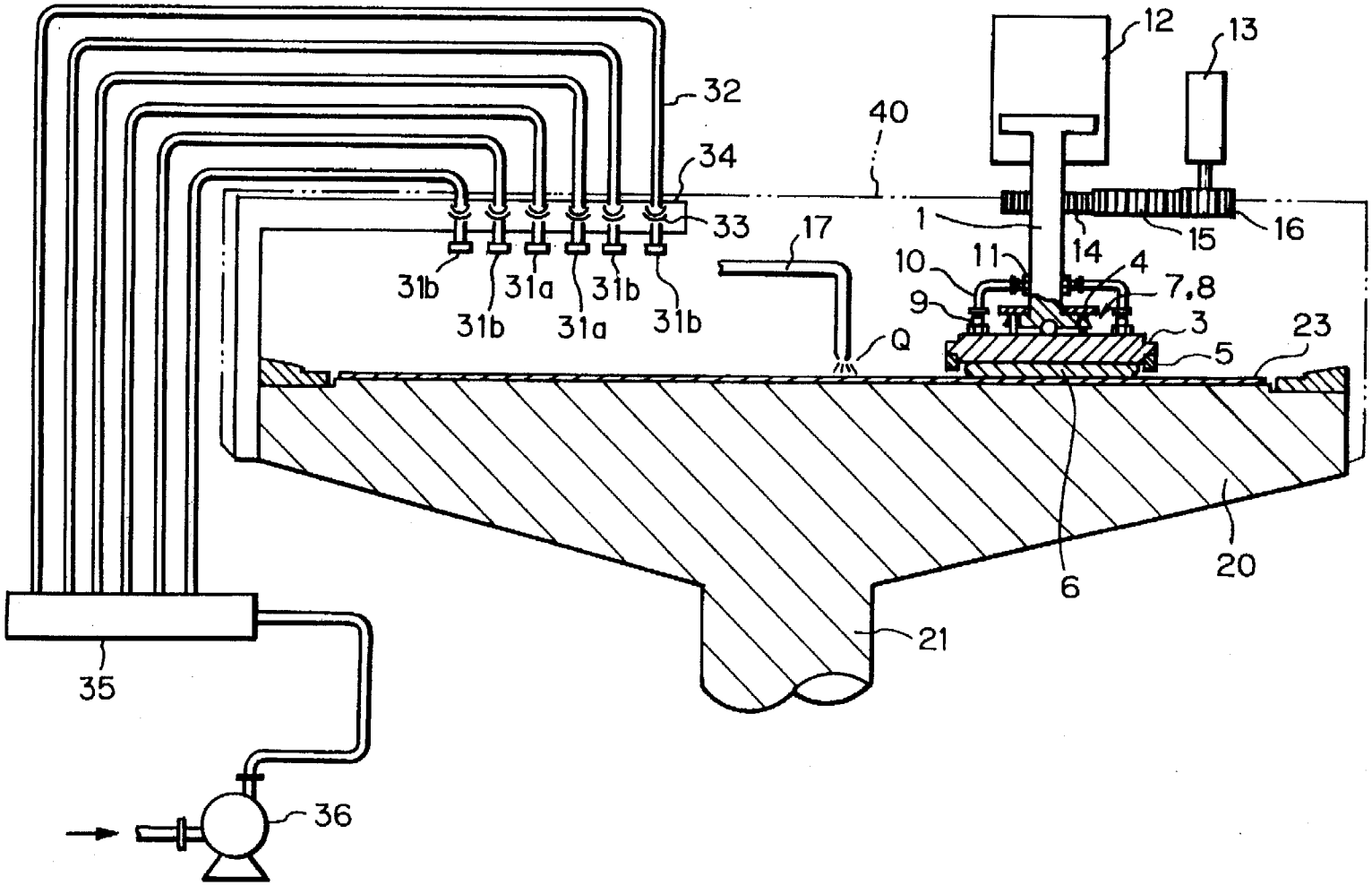
FIG. 3 is a longitudinal cross-sectional view showing the general arrangement of the polishing apparatus in one embodiment of the present embodiment.

FIG. 3 is a view illustrating the general construction of the polishing apparatus in which the polishing portion in FIGS. 1 and 2 is used. In FIG. 3, a reference numeral 20 represents a turntable which is adapted to rotate around the shaft 21. The polishing cloth 23 is applied over the upper surface of the turntable 20.

The turntable 20 is provided at its upper portion with the top ring portion. The top ring driving shaft i is provided at its upper portion with the top ring cylinder 12, and the top ring 3 is adapted to be urged against the turntable 20 with a certain urging pressure by means of top ring cylinder 12. A numeral 13 is a top ring driving motor which is adapted to apply a rotation torque to the top ring driving shaft 1 via gears 14, 15 and 16. The polishing/abrasive liquid spray nozzle 17 is arranged above the turntable 20, and is adapted to spray a polishing/abrasive liquid Q over the polishing cloth 23 of the turntable 20.

Next, the manner of polishing the wafer by means of the polishing apparatus of the above-described construction will be described.

Description will be made in such a case wherein the semiconductor is an object to be polished.

The semiconductor wafer 6 is applied by vacuum against the lower surface of the top ring body lower portion 3-2. To allow the semiconductor 6 to be sucked against the lower surface of the top ring body lower portion 3-2, air is withdrawn through vacuum-section ports 3-2*a* defined in the top ring body lower portion 3-2 and vacuum port 1*b* defined in the central portion of the top ring driving shaft 1 by a vacuum source. The semi-conductor wafer is applied by vacuum pressure against the lower surface of the top ring 3, from a delivery portion (not shown) which is arranged adjacent to the turntable 20.

Then, after the top ring 3 upon which the semi-conductor 6 is retained is shifted onto the turntable 20, the top ring 3 is lowered to place the semiconductor wafer 6 upon the polishing cloth 23 on the upper surface of the turntable 20. Then, atmospheric air is passed into the vacuum suction ports 3-2*a* by disconnecting the vacuum port 1*b* from the vacuum pressure source. Consequently, the semiconductor 6 is released from the lower surface of the top ring 3, and the semiconductor 6 is adapted to rotate against the lower surface of the top ring 3. By rotating the turntable 20 and the top ring 3, and actuating the top ring cylinder 12 to push the top ring 3 toward the turntable 20, the semiconductor 6 is urged against the polishing cloth 23 mounted upon the upper surface of the turntable 20. A polishing/abrasive liquid Q is caused to flow onto the polishing cloth 23 from the polishing/abrasive liquid spray nozzle 17, and the polishing/abrasive liquid Q is retained in the polishing cloth. Consequently, the polishing/abrasive solution Q reaches the surface (lower surface) of the semiconductor wafer to be polished, and thus the polishing operation may be initiated.

After the polishing operation is completed, the semiconductor wafer 6 is again drawn by vacuum against the lower surface of the top ring 3, and the top ring 3 is caused to shift from the turntable 30 to deliver the semiconductor wafer 6 into a cleaning station and the like.

A mechanism for carrying out a dressing operation will be described. In the apparatus as shown in FIG. 3, water jets are sprayed against the surface of the polishing cloth 23 through nozzles 31*a* and 31*b* which are fixed in position on nozzle support member 34 by means of nozzle fixture 33. A plurality of each of nozzles 31*a* and 31*b* are arranged in spaced positions in a dimensional direction of the polishing cloth 23. Flow velocity, flow rate, angle of spray, and cross-sectional configuration of the nozzles 31*a* and 31*b* vary from each other. Water is pressurized by a pump 36 and is then delivered to tubes 32 corresponding to respective nozzles via a branch pipe 35. Water is then supplied to respective nozzles 31*a* and 31*b* through tubes 32 to be sprayed as jets from the nozzles. The nozzles are arranged and oriented such that water which is sprayed from the nozzles strikes the area on the polishing cloth 23 where polishing is to be carried out, i.e., against which a wafer 6 is urged and polished.

A collision pressure which is generated when a water jet strikes the cloth surface is used as a water impact pressure, and the volume of the water provided is in proportion to its density, flow velocity, spray stream and sonic velocity. Such water impact pressure serves to loosen abrasive grains which have accumulated in the cloth, and such grains are then be discharged together with the water.

A cover 40 may be provided to prevent water from splashing circumferentially as shown by phantom lines in FIG. 3.

Figure 4:
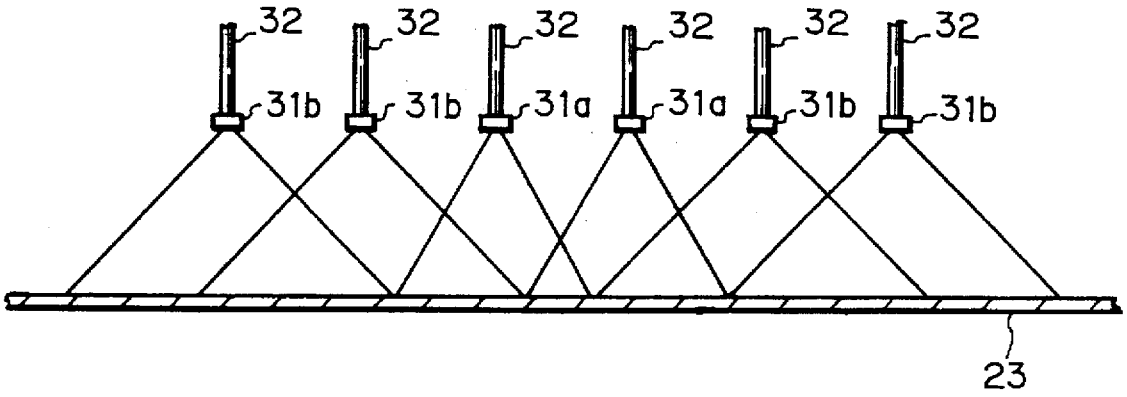
FIG. 4 is a view showing a nozzle array in which water nozzles are arranged in one embodiment of the present invention.
Figure 5:
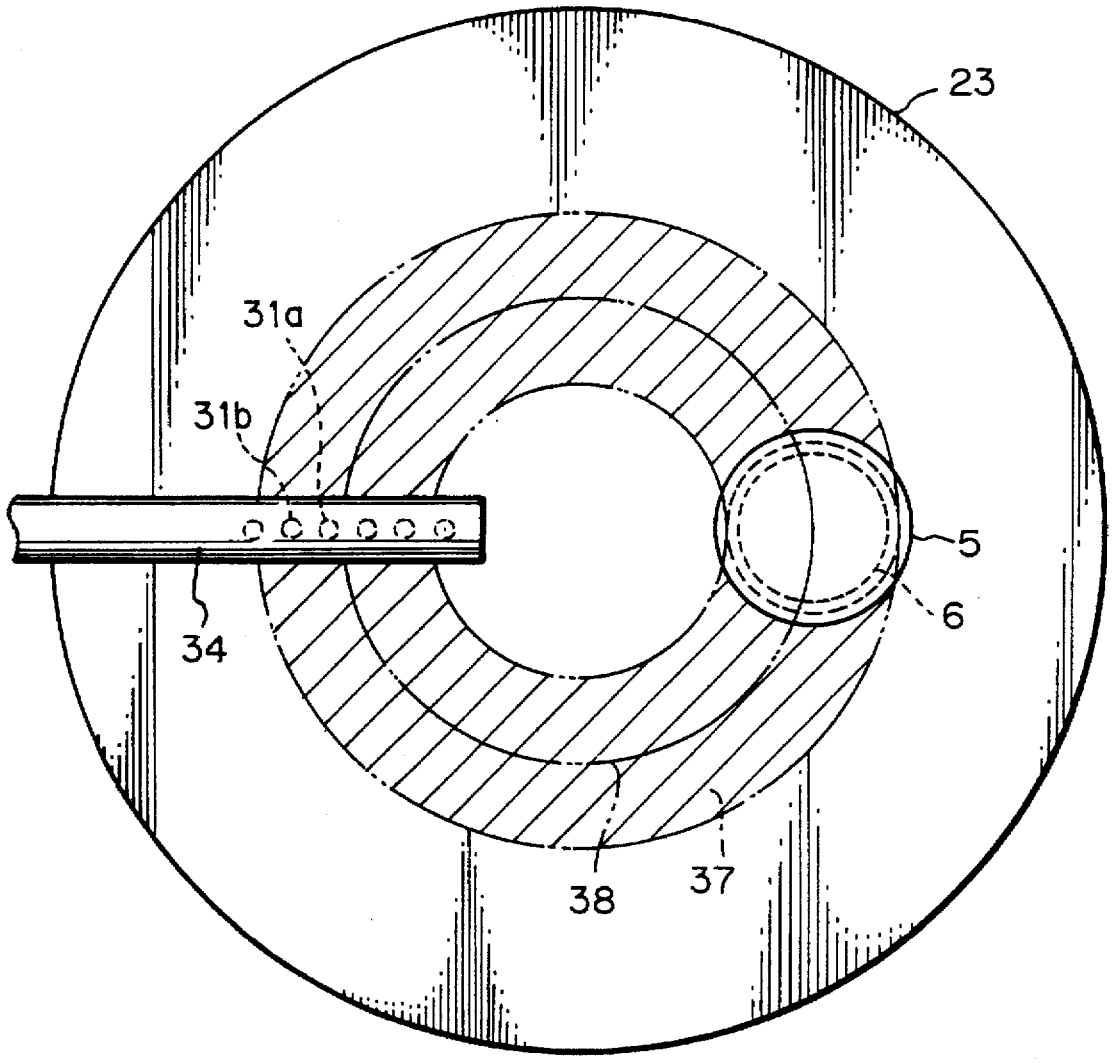
FIG. 5 is a plan view showing one embodiment of the present invention.

FIG. 4 is a view illustrating a difference in the angle of water spray, i.e. a diffusion angle, between nozzles 31*a* and 31*b*. Further, FIG. 5 is a plan view illustrating the area on the polishing cloth where polishing is carried out, in conjunction with the nozzle position. FIG. 5 shows only components necessary for illustration of the invention, omitting those members which are not necessary for explanation. In FIG. 5, the shaded area 37 indicates the area on the polishing cloth where polishing is carried out, and a dotted line 38 indicates a center of the area 37 where polishing is carried out.

The nozzle 31*a* is arranged to spray a water jet against an area close to the center 38 of the area where polishing is carried out, whereas the nozzle 31*b* is arranged to spray a water jet against an area more remote from the center 38 of the area where polishing is carried out. As shown in FIG. 4, the angle of water spray from the nozzle 31*a* is made to be smaller than that of a water jet to be sprayed from the nozzle 31*b*. This difference in the angle of water spray serves to make the water impact pressure from the nozzle 31*a* (magnitude of total water impact pressure per unit area and unit time) to be greater than that sprayed from the nozzle 31*b*. Consequently, the water jet having a greater impact pressure strikes a portion closer to the center 38 in the area in the polishing cloth 23 where polishing is carried out, whereas a relatively reduced water jet strikes a portion remote from the center 38. As a result, the impact jet pressure which strikes a portion closer to the center 38 is made greater than that of a jet which strikes the portion remote from the center 38.

As a polishing operation proceeds, abrasive grains accumulate in the polishing cloth, at an area closer to the center 38 of the area where polishing is carried out, with the volume of grains decreasing relatively as the distance from the center 38 increases. By using nozzles having a varied spray angle in combination as a means for carrying out a dressing operation, it is possible to apply a water jet of greater impact pressure on an area closer to the center of an area where polishing is carried out, with a water jet of reduced impact pressure being applied on an area remote from the center 38 of the area where polishing is carried out. Thus, abrasive grains which have been degraded may be discharged in a more efficient manner, thereby causing the volume of abrasive grains to be distributed evenly in the polishing cloth 23 after a dressing operation is complete.

In relation to the above-described embodiment, microscopic observation of a cloth surface which has been dressed indicates that degraded abrasive grains are discharged in an improved manner. Furthermore, subsequent polishing is more effective than when a conventional method is employed.

In the above-described embodiment, a nozzle array is formed in which a nozzle having a reduced spray angle is provided as a nozzle closer to the center, and a nozzle having a greater spray angle is provided as the nozzle proximate to the end. However, the nozzle proximate to the center may be provided with an increased spray angle, if various polishing conditions are employed. There may be some instances where an impact pressure distribution may be required to be varied from that employed in this embodiment. However, such variance falls within the scope of the present invention, whereby an impact pressure may be distributed in a manner different from that described above.

In the embodiment shown herein, an impact pressure distribution is realized by varying the nozzle configuration for a plurality of nozzles, but alternative approaches may be utilized to provide similar effects. A plurality of tubes arranged for supplying water to nozzles may be provided with respective valves, and a water jet may be controlled by manipulating the valves. A pressure source such as a pump, etc., may be provided for respective nozzles to thereby vary water jets. Such arrangements also fall within the scope of the present invention.

Figure 6A:
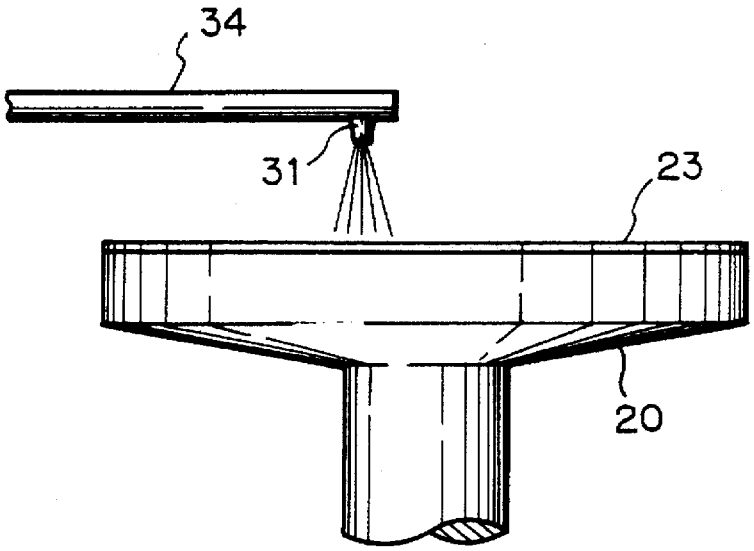
FIG. 6*a* is a longitudinal cross-sectional view showing an alternative embodiment of the present invention and FIG. 6*b* is a longitudinal cross-sectional view showing an alternative embodiment of the present invention.
Figure 6B:
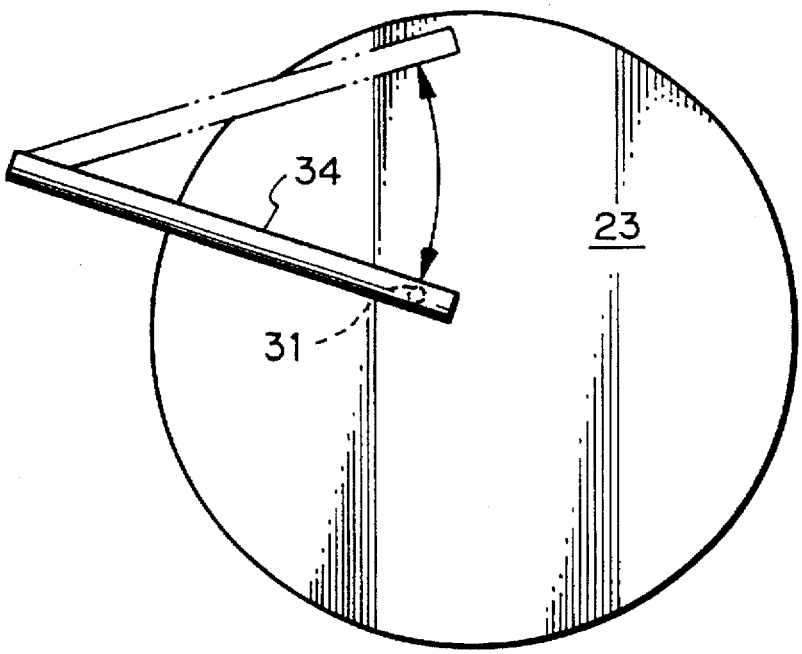

Other embodiments will be described with reference to FIGS. 6*a* and 6*b*. FIG. 6*a* is an elevation view showing the turntable and the fluid jet nozzle for the dressing operation in the polishing apparatus according to the present invention. In this embodiment, a single nozzle 31 is provided, but the fluid jet may cover the entire area of the polishing cloth 23, because the nozzle supporting member 34 travels over the polishing cloth 23 in an oscillating manner during a dressing operation, as shown by an arrow in FIG. 6*b*. Besides, even though only a single fluid jet is provided, it is possible to vary time expended on dressing to influence respective portions of the polishing cloth 23, thereby ensuring an effect similar to that provided in such a case where a plurality of nozzles is employed, as described above, by suitably determining a pattern of travel of the nozzle supporting member 34, and the rotation speed of the turntable.

In the above-described embodiment, although a water jet is used, the present invention may also be applied to a dressing operation in which a liquid other than water and a gas are used as a jet to dress the object.

In the above-described embodiment, although polishing apparatus and method for polishing a semiconductor wafer into a flat and mirror-like configuration are described, the object to be polished is not limited to a semiconductor wafer.

Moreover, in the above-described embodiment, although the present invention has been described with reference to an embodiment in which a single semiconductor wafer is polished with a single top ring, it is also possible to provide an alternative embodiment in which a template-like top ring is formed with a plurality of water ports so that a plurality of wafers may be polished in a similar manner.

The present invention is also applicable to a case in which a fluid jet is used to dress a polishing cloth for use in a polishing apparatus whereby an object is polished by means of a roller around which a polishing cloth is wound.

(Effect of the Invention)

As above-described, in accordance with the present invention, a dressing operation may be carried out on a polishing cloth which does not have an even configuration when a fluid jet such as a water jet, etc., is applied against the polishing cloth to dress the cloth. Therefore, an entire surface of the polishing cloth can be dressed in an even manner, thereby improving its operating efficiency.

We claim:

1. An apparatus for polishing an object by urging a surface of the object against a surface of a polishing cloth while causing relative movement therebetween and supplying a polishing liquid therebetween, said polishing apparatus including a dressing apparatus for dressing said polishing cloth to renew said polishing cloth for continued polishing, said dressing apparatus comprising:

a plurality of nozzles for spraying respective fluid jets against said surface of said polishing cloth, said nozzles having respective axes located at different distances from a rotational axis of said polishing cloths; and means for varying impact pressure imparted by said fluid jets to said surface of said polishing cloth over different areas thereof.

2. An apparatus as claimed in claim 1, wherein said means comprises means for providing that a flow velocity of said fluid jet from at least one said nozzle is different than a flow velocity of said fluid jet from at least one other said nozzle.

3. An apparatus as claimed in claim 2, wherein flow velocities of said fluid jets from all of said nozzles are different.

4. An apparatus as claimed in claim 1, wherein said means comprises means for providing that a flow rate of said fluid jet from at least one said nozzle is different than a flow rate of at least one other said nozzle.

5. An apparatus as claimed in claim 4, wherein flow rates of said fluid jets of all of said nozzles are different.

6. An apparatus as claimed in claim 1, wherein said means comprises means for providing that an angle of spray of said fluid jet from at least one said nozzle is different than an angle of spray of said fluid jet from at least one other said nozzle.

7. An apparatus as claimed in claim 6, wherein angles of spray of said fluid jets of all of said nozzles are different.

8. An apparatus as claimed in claim 1, wherein said means comprises at least one said nozzle having a cross-sectional configuration different from a cross-sectional configuration of at least one other said nozzle.

9. An apparatus as claimed in claim 8, wherein all of said nozzles have different cross-sectional configurations.

10. An apparatus as claimed in claim 1, wherein said means comprises means for providing that a cross-sectional configuration of said fluid jet from at least one said nozzle is different than a cross-sectional configuration of said fluid jet from at least one other said nozzle.

11. An apparatus as claimed in claim 10, wherein cross-sectional configurations of all of said fluid jets are different.

12. An apparatus as claimed in claim 1, wherein said nozzles are connected to respective fluid supply sources that provide at least one of different supply pressure and different flow rate.

13. An apparatus as claimed in claim 1, wherein each said nozzle has connected thereto a respective fluid supply line, and each said fluid supply line has a valve or orifice to control selectively the supply of fluid to the respective said nozzle.

14. An apparatus as claimed in claim 1, further comprising means to blend cavitation bubbles into at least one said fluid jet.

15. An apparatus as claimed in claim 1, further comprising a cover covering said nozzles and polishing cloth to prevent splashing of fluid from said fluid jets.

16. A dressing apparatus for dressing a polishing cloth to be employed in a polishing apparatus used for polishing an object by urging a surface of the object against a surface of the polishing cloth while causing relative movement therebetween and supplying a polishing liquid therebetween, said dressing apparatus comprising:

a plurality of nozzles for spraying respective fluid jets against the surface of the polishing cloth, said nozzles having respective axes to be located at different distances from a rotational axis of the polishing cloth; and means for varying impact pressure to be imparted by said fluid jets to the surface of the polishing cloth over different areas thereof.

17. An apparatus as claimed in claim 16, wherein said means comprises means for providing that a flow velocity of said fluid jet from at least one said nozzle is different than a flow velocity of said fluid jet from at least one other said nozzle.

18. An apparatus as claimed in claim 17, wherein flow velocities of said fluid jets from all of said nozzles are different.

19. An apparatus as claimed in claim 16, wherein said means comprises means for providing that a flow rate of said fluid jet from at least one said nozzle is different than a flow rate of at least one other said nozzle.

20. An apparatus as claimed in claim 19, wherein flow rates of said fluid jets of all of said nozzles are different.

21. An apparatus as claimed in claim 16, wherein said means comprises means for providing that an angle of spray of said fluid jet from at least one said nozzle is different than an angle of spray of said fluid jet from at least one other said nozzle.

22. An apparatus as claimed in claim 21, wherein angles of spray of said fluid jets of all of said nozzles are different.

23. An apparatus as claimed in claim 16, wherein said means comprises at least one said nozzle having a cross-sectional configuration different from a cross-sectional configuration of at least one other said nozzle.

24. An apparatus as claimed in claim 23, wherein all of said nozzles have different cross-sectional configurations.

25. An apparatus as claimed in claim 16, wherein said means comprises means for providing that a cross-sectional configuration of said fluid jet from at least one said nozzle is different than a cross-sectional configuration of said fluid jet from at least one other said nozzle.

26. An apparatus as claimed in claim 25, wherein cross-sectional configurations of all of said fluid jets are different.

27. An apparatus as claimed in claim 16, wherein said nozzles are connected to respective fluid supply sources that provide at least one of different supply pressure and different flow rate.

28. An apparatus as claimed in claim 16, wherein each said nozzle has connected thereto a respective fluid supply line, and each said fluid supply line has a valve or orifice to control selectively the supply of fluid to the respective said nozzle.

29. An apparatus as claimed in claim 16, further comprising means to blend cavitation bubbles into at least one said fluid jet.

30. A method of dressing a polishing cloth employed in a polishing operation wherein a surface of an object is polished by urging said surface against a surface of the polishing cloth while causing relative rotation therebetween and supplying a polishing liquid therebetween, said method comprising:

spraying fluid jets against said surface of said polishing cloth from a plurality of respective nozzles having respective axes located at different distances from a rotational axis of said polishing cloth; and varying impact pressure imparted by said fluid jets to said surface of said polishing cloth over different areas thereof.

31. A method as claimed in claim 30, wherein said varying comprises providing that a flow velocity of said fluid jet from at least one said nozzle is different than a flow velocity of said fluid jet from at least one other said nozzle.

32. A method as claimed in claim 31, wherein flow velocities of said fluid jets from all of said nozzles are different.

33. A method as claimed in claim 30, wherein said varying comprises providing that a flow rate of said fluid jet from at least one said nozzle is different than a flow rate of at least one other said nozzle.

34. A method as claimed in claim 33, wherein flow rates of said fluid jets of all of said nozzles are different.

35. A method as claimed in claim 30, wherein said varying comprises providing that an angle of spray of said fluid jet from at least one said nozzle is different than an angle of spray of said fluid jet from at least one other said nozzle.

36. A method as claimed in claim 35, wherein angles of spray of said fluid jets of all of said nozzles are different.

37. A method as claimed in claim 30, wherein said varying comprises providing that at least one said nozzle has a cross-sectional configuration different from a cross-sectional configuration of at least one other said nozzle.

38. A method as claimed in claim 37, wherein all of said nozzles have different cross-sectional configurations.

39. A method as claimed in claim 30, wherein said varying comprises providing that a cross-sectional configuration of said fluid jet from at least one said nozzle is different than a cross-sectional configuration of said fluid jet from at least one other said nozzle.

40. An apparatus as claimed in claim 39, wherein cross-sectional configurations of all of said fluid jets are different.

41. A method as claimed in claim 30, comprising connecting said nozzles to respective fluid supply sources that provide at least one of different supply pressure and different flow rate.

42. A method as claimed in claim 30, comprising connecting each said nozzle to a respective fluid supply line having a valve or orifice to control selectively the supply of fluid to the respective said nozzle.

43. A method as claimed in claim 30, further comprising blending cavitation bubbles into at least one said fluid jet.

44. A method as claimed in claim 30, further comprising covering said nozzles and polishing cloth to prevent splashing of fluid from said fluid jets.

45. A method as claimed in claim 30, wherein said fluid jets comprise water jets.

46. An apparatus for polishing an object by urging a surface of the object against a surface of a polishing cloth while causing relative movement therebetween and supplying a polishing liquid therebetween, said polishing apparatus including a dressing apparatus for dressing said polishing cloth to renew said polishing cloth for continued polishing, said dressing apparatus comprising:

at least one nozzle for spraying a fluid jet against said surface of said polishing cloth; and means for moving said nozzle over said surface of said polishing cloth and for varying the time that said fluid jet impacts onto different areas thereof.

47. An apparatus as claimed in claim 46, further comprising means to blend cavitation bubbles into said fluid jet.

48. An apparatus as claimed in claim 46, further comprising a cover covering said nozzle and said polishing cloth to prevent splashing of fluid from said fluid jet.

49. An apparatus as claimed in claim 46, wherein said polishing cloth is mounted on a rotatable turntable, and further comprising means for varying the speed of rotation of said turntable during movement of said nozzle over said surface of said polishing cloth.

50. An apparatus as claimed in claim 46, wherein said nozzle is supported by a nozzle support member, and said means comprises means for moving said nozzle support member over the polishing cloth.

51. A dressing apparatus for dressing a polishing cloth to be employed in a polishing apparatus used for polishing an object by urging a surface of the object against a surface of the polishing cloth while causing relative movement therebetween and supplying a polishing liquid therebetween, said dressing apparatus comprising:

at least one nozzle for spraying a fluid jet against the surface of the polishing cloth; and means for moving said nozzle over the surface of the polishing cloth and for varying the time that said fluid jet impacts onto different areas thereof.

52. An apparatus as claimed in claim 51, further comprising means to blend cavitation bubbles into said fluid jet.

53. An apparatus as claimed in claim 51, wherein said nozzle is supported by a nozzle support member, and said means comprises means for moving said nozzle support member over the polishing cloth.

54. A method of dressing a polishing cloth employed in a polishing operation wherein a surface of an object is polished by urging said surface against a surface of the polishing cloth while causing relative rotation therebetween and supplying a polishing liquid therebetween, said method comprising:

spraying a fluid jet from a nozzle against said surface of said polishing cloth; and moving said nozzle over said surface of said polishing cloth and varying the time that said fluid jet impacts onto different areas thereof.

55. A method as claimed in claim 54, further comprising blending cavitation bubbles into said fluid jet.

56. A method as claimed in claim 54, further comprising covering said nozzle and said polishing cloth to prevent splashing of fluid from said fluid jet.

57. A method as claimed in claim 54, wherein said fluid jet comprises a water jet.

58. A method as claimed in claim 54, wherein said polishing cloth is mounted on a rotatable turntable, and further comprising varying the speed of rotation of said turntable during movement of said nozzle over said surface of said polishing cloth.

59. A method as claimed in claim 54, wherein said nozzle is supported by a nozzle support member, and said moving comprises moving said nozzle support member over said polishing cloth.

* * * * *